US006091314A

United States Patent [19]

Wright et al.

[11] Patent Number: 6,091,314

[45] Date of Patent: Jul. 18, 2000

[54] PIEZOELECTRIC BOOSTER FOR AN ELECTROMAGNETIC ACTUATOR

[75] Inventors: Danny O. Wright, Cobb's Creek; Louis G. DeGrace, Newport News, both of Va.

[73] Assignee: Siemens Automotive Corporation, Auburn Hills, Mich.

[21] Appl. No.: 09/306,621

[22] Filed: May 6, 1999

Related U.S. Application Data

[60] Provisional application No. 60/088,145, Jun. 5, 1998.

[51] Int. Cl.[7] ..... H01F 7/08

[52] U.S. Cl. ..... 335/220; 310/328; 251/129.15

[58] Field of Search ..... 335/220, 221, 335/229, 266, 268, 269; 251/129.11, 129.15, 129.1, 129.09, 129.06; 310/328

[56] References Cited

U.S. PATENT DOCUMENTS

| | | | |
|---|---|---|---|
| 4,382,243 | 5/1983 | Babitzka et al. . | |
| 4,455,543 | 6/1984 | Pischinger et al. | 335/266 |
| 4,593,658 | 6/1986 | Moloney . | |
| 4,678,000 | 7/1987 | Kushida | 137/1 |
| 4,715,330 | 12/1987 | Buchl . | |
| 4,750,706 | 6/1988 | Schlagmüller . | |
| 5,109,885 | 5/1992 | Tauscher | 137/554 |
| 5,593,134 | 1/1997 | Steber et al. . | |
| 5,636,601 | 6/1997 | Moriya et al. . | |
| 5,645,226 | 7/1997 | Bright . | |
| 5,775,278 | 7/1998 | Moriya et al. . | |
| 5,799,630 | 9/1998 | Moriya et al. . | |
| 5,799,926 | 9/1998 | Moriya et al. . | |
| 5,813,653 | 9/1998 | Esch et al. | 251/129.1 |

FOREIGN PATENT DOCUMENTS

| | | |
|---|---|---|
| 197 35 375 | 8/1997 | Germany . |

*Primary Examiner*—Lincoln Donovan

[57] ABSTRACT

An electromagnetic actuator 10 includes first and second electromagnets 12 and 18, respectively. The second electromagnet 18 is in spaced relation with respect to the first electromagnet 12. An armature 24 is mounted for movement between the first and second electromagnets. An engaged position of the armature 24 is defined when the armature contacts one of the electromagnets 12 or 18 with an electrical signal to the contacted electromagnet being turned-off. Spring structure 30 is operatively associated with the armature 24 to bias the armature 24 away from the engaged position thereof. A piezoelectric device 34 is operatively associated with the armature 24 so that when the armature is in the engaged position and a force of the spring structure 30 is insufficient to move the armature from contact with the contacted electromagnet, the piezoelectric device 34 may be energized so as to move the armature 24 from contact with the contacted electromagnet.

20 Claims, 1 Drawing Sheet

PIEZOELECTRIC BOOSTER FOR AN ELECTROMAGNETIC ACTUATOR

This application claims the benefit of U.S. Provisional Application 60/088,145, filed Jun. 5, 1998.

FIELD OF THE INVENTION

This invention relates to an electromagnetic actuator and more particularly to a piezoelectric device to initiate movement of an armature contacting a stator core of the electromagnetic actuator.

BACKGROUND OF THE INVENTION

A conventional electromagnetic actuator for opening and closing a valve of an internal combustion engine generally includes an electromagnet having a coil and a stator core. When the coil is energized an electromagnetic force is produced on an armature. The armature is biased by a return spring and the armature is coupled with a cylinder valve of the engine. The armature is held at the stator core in one operating position of the actuator and, by deenergizing the coil, the armature may move towards and into another operating position by the return spring.

In the above described high speed electromagnetic actuator, a relatively long delay in release of the armature from the stator core may occur due to the time required to dissipate the magnetic field required to generate a holding force on the armature. Further, the time of actual break-away of the armature from the stator core is delayed due to mechanical sticking of the armature/stator core interfaces, enhanced by the presence of oil, and further delayed, in the case of actuators for exhaust valves, by exhaust back pressure, which must be overcome to open the valve. These conditions may cause limitations on high speed and high engine load operation by limiting the maximum rpm achievable.

While measured in small fractions of a second, these delays can be significant in electromagnetic actuators, since in order for the engine to reach high revolutions per minute, fractions of a millisecond are important in operation of the actuator.

Attempts have been made to alleviate the mechanical "sticking" of the armature at a stator core. For example, increasing spring rates of springs acting on the armature have been proposed, but this proposal can lead to an unacceptable size of the actuator and increased power requirements of the actuator magnetic circuit.

Thus, there is a need to move an armature of an electromagnetic actuator from engagement with a stator core with high force and within milliseconds.

SUMMARY OF THE INVENTION

An object of the present invention is to fulfill the need referred to above. In accordance with the principles of the present invention, this objective is obtained by providing an electromagnetic actuator including first and second electromagnets. The second electromagnet is in spaced relation with respect to the first electromagnet. An armature is mounted for movement between the first and second electromagnets. An engaged position of the armature is defined when the armature contacts one of the electromagnets with an electrical signal to the contacted electromagnet being turned-off. Spring structure is operatively associated with the armature to bias the armature away from the engaged position thereof. A piezoelectric device is operatively associated with the armature so that when the armature is in the engaged position and a force of the spring structure is insufficient to move the armature from contact with the contacted electromagnet, the piezoelectric device may be energized so as to move the armature from contact with the contacted electromagnet.

In accordance with another aspect of the invention, a method is provided to move an armature from contact with an electromagnet. The method includes operatively associating a piezoelectric device with the armature and energizing the piezoelectric device to move the armature from contact with the electromagnet.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE INVENTION

Figure 1:
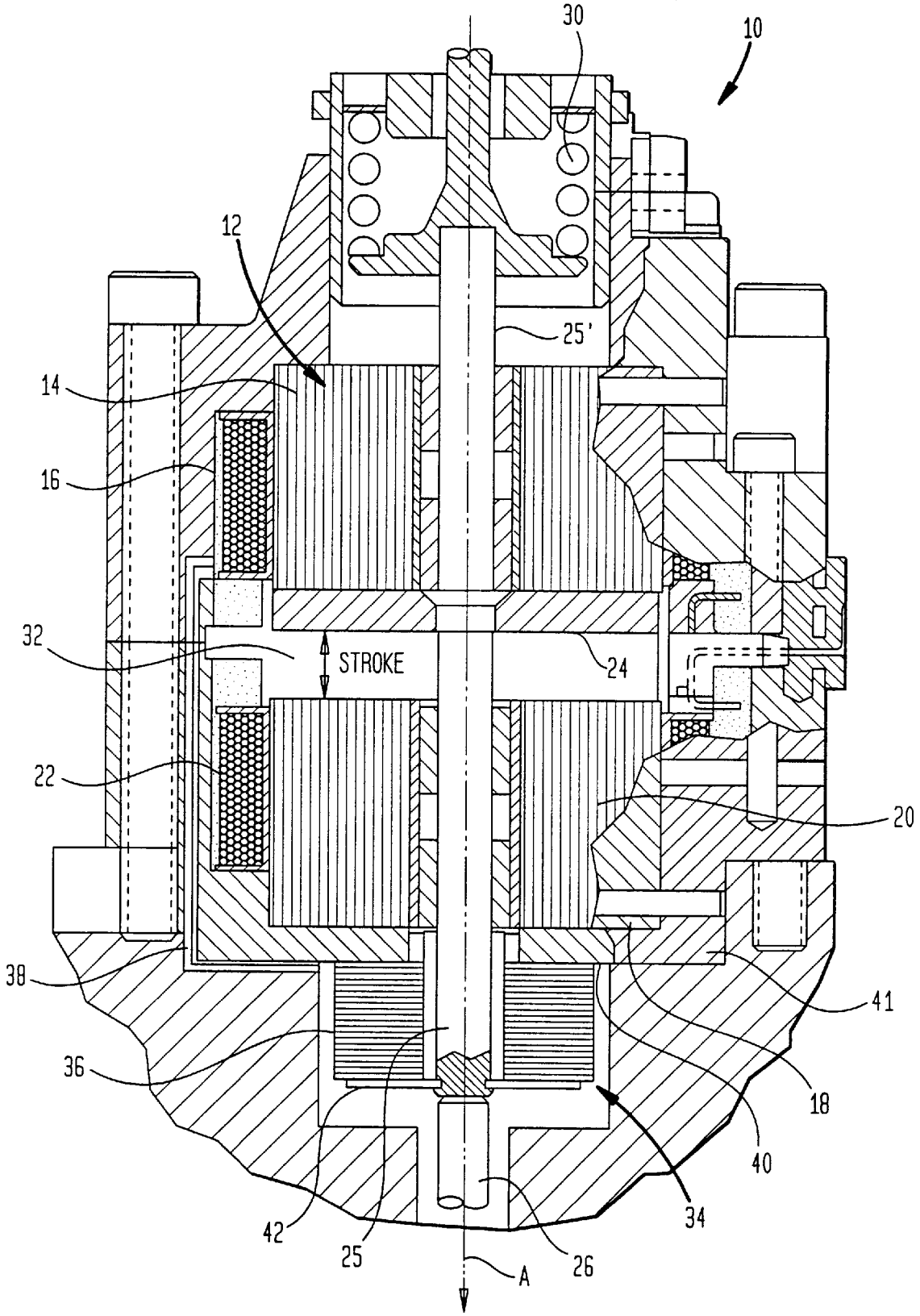
FIG. 1 is a cross-sectional view of an electromagnetic actuator having a piezoelectric device, provided in accordance with the principles of the present invention.

Referring to FIG. 1, an electromagnetic actuator is shown, generally indicated 10, provided in accordance with the principles of the present invention.

The electromagnetic actuator 10 includes a first electromagnet, generally indicated at 12, which includes a stator core 14 and a solenoid coil 16 associated with the stator core 14. A second electromagnet, generally indicated at 18, is disposed generally in opposing relation with respect to the first electromagnet 12. The second electromagnet 18 includes a stator core 20 and a solenoid coil 22 associated with the stator core 20. The electromagnetic actuator 10 includes an ferromagnetic armature 24 which is attached to a stem 26 of a fluid exchange valve (not shown) via shaft 25. Shaft 25 is coupled to the armature 24. The armature 24 is disposed between the electromagnets 12 and 18 so as to be acted upon by the an electromagnetic force created by the electromagnets. In a deenergized state of the electromagnets 12 and 18, the armature 24 is maintained in a position of rest generally between the two electromagnets 12 and 18 by opposing working return springs, one of which is shown at 30. The other return spring (not shown) is associated with stem 26. In a valve closed position (FIG. 1), the armature 24 engages the stator core 14 of the first electromagnet 12.

Each stator core and associated coil together with the armature 24 define a magnetic circuit of the actuator 10. Further, as shown in FIG. 1, an air gap 32 is provided between the armature 24 and electromagnet 18. It can be appreciated that an air gap is defined between the armature 24 and the upper electromagnet 12 at certain times during the oscillation of the armature 24. The air gap 32 is the magnetic discontinuity in a ferromagnetic circuit which increases the reluctance (resistance to flux) of the circuit.

With reference to FIG. 1, in a held position, the armature 24 is in contact with the stator core 14 and held there by a hold current supplied to electromagnet 12. When it is desired to move the armature toward the other electromagnet 18, the hold current is removed from electromagnet 12 thereby defining an engaged position with the armature still in contact with the stator core 14. At this time, the force of spring 30 acting on shaft 25 and thus armature 24 may be insufficient to break the armature/stator core contact.

Thus, in order to aid in the initial movement of the armature 24 from the engaged position to a position disengaged with the stator core 14, a piezoelectric device, generally indicated at 34, is operatively associated with the armature 24. The piezoelectric device 34 comprises a plurality of piezoceramic discs 36 which are electrically connected in series and may subjected to DC voltage applied through a pair of leads 38. One end 40 of the piezoelectric device 34 is fixed to a housing 41 while the other end of the piezoelectric device 34 is coupled to a plate 42 which in turn is fixed to a portion of the shaft 25 which extends beyond an extent of electromagnet 18. As noted above, shaft 25 is coupled with the armature 24. Thus, when a voltage is applied to the piezoelectric device 34, the discs 36 expand in the direction of arrow A with simultaneous contraction in their diameter. This causes the shaft 25 to move and thus causes the armature 24 to be moved from contact with the stator core 14. Once this occurs, the voltage to the piezoelectric device 34 is terminated. Thus, the piezoelectric device 34 functions to simply "break" the contact between the armature 24 and the stator core 14. Although the piezoelectric device 34 is coupled to the shaft 25 which is in turn coupled to the armature 24, it is within the contemplation of the invention to couple the piezoelectric device 34 directly to the armature 24.

The piezoelectric device 34 is known and may be of the type disclosed in U.S. Pat. No. 4, 593, 658, the contents of which is hereby incorporated into the present specification by reference. The piezoelectric device 34 is advantageous for performing the function of breaking the armature 24 from contact with a stator core since the device can deliver a very high force in typically less than 0.0001 seconds. The piezoelectric device 34 reduces the "sticking" time, which is the time between the end of the "holding" electrical signal to electromagnet 12, until the magnetic force decays sufficiently to allow the armature to begin motion from pressure of spring 30 alone. A secondary benefit of the piezoelectric device 34 is the additional force provided on the armature 24 to help propel the armature 24 to the opposing electromagnet 18.

Once the armature 24 is removed from contact with the stator core 14 by the piezoelectric device 34, the coil spring 30 provides the force necessary to move the armature towards electromagnet 18 and "catch" and "hold" currents are supplied in the known manner to coil 22 of electromagnet 18 to catch and hold the armature 24 at stator core 20.

To provide proper timing as well as the necessary electrical power to the piezoelectric device 34 in a low voltage system (generally 12–42 volts), the back EMF voltage generated when the electrical signal to the holding electromagnet 14 is turned off may be used. In a high voltage system (e. g. , 150 volts), the timing is still referenced to turn on the holding electromagnet, but the power can be switched directly from the power supply to activate the piezoelectric device 34. The above-described timing and power provisions are merely exemplary and any schemes for generating and applying electric power to the piezoelectric device are within the contemplation of the invention.

Although a piezoelectric device 34 was shown and described with regard to breaking the contact of armature 24 from electromagnet 12, it can be appreciated that a second piezoelectric device (not shown) may be coupled with portion 25' of shaft 25 to break the connection of the armature 24 from electromagnet 18 when the armature 24 is contacting the stator core 20 of the electromagnet 18. In that regard, the second piezoelectric device would be energized to move shaft 25 in a direction opposite arrow A and thus break the contact between the armature 24 with the stator core 20 of electromagnet 18.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An electromagnetic actuator comprising:

a first electromagnet, a second electromagnet in spaced relation with respect to said first electromagnet, said first and second electromagnets being controlled by an electrical signal, an armature mounted for movement between said first and second electromagnets, an engaged position of said armature being defined when said armature contacts one of said electromagnets with said electrical signal to the contacted electromagnet being turned-off, spring structure operatively associated with said armature to bias said armature away from said engaged position thereof, a piezoelectric device operatively associated with said armature so that when said armature is in said engaged position and a force of said spring structure is insufficient to move said armature from contact with said contacted electromagnet, said piezoelectric device is constructed and arranged so that upon being energized, said piezoelectric device moves said armature from contact with said contacted electromagnet.

2. The electromagnetic actuator according to claim 1, wherein said piezoelectric device comprises plurality of piezoelectric elements defining a stack, said piezoelectric elements expand in length when energized.

3. The electromagnetic actuator according to claim 2, wherein one end of said stack is fixed to a surface of a housing containing one of said electromagnets, an opposite end of said stack being coupled to a shaft, said shaft being coupled to said armature.

4. The electromagnetic actuator according to claim 2, wherein each of said piezoelectric elements are of disc-shape.

5. The electromagnetic actuator according to claim 4, wherein said piezoelectric elements are composed of ceramic.

6. The electromagnetic actuator according to claim 1, wherein said spring structure is a coil spring.

7. The electromagnetic actuator according to claim 1, including a voltage source to provide said electrical signal to said electromagnets, and wherein said piezoelectric device is constructed and arranged so as to be powered by EMF voltage which is generated when the electrical signal to said contacted electromagnet is turned-off.

8. An electromagnetic actuator comprising:

a first electromagnet including a stator core and a coil operatively associated with said stator core, a second electromagnet in spaced relation with respect to said first electromagnet, said second electromagnet having a stator core and a coil operatively associated with said stator core of said second electromagnet, said coils of said first and second electromagnets being controlled by an electrical signal, an armature mounted for movement between said first and second electromagnets, an engaged position of said armature being defined when said armature contacts one of said stator cores with the electrical signal to the coil associated with the contacted stator core being turned-off, a shaft coupled with said armature for movement therewith, spring structure operatively associated with said shaft to bias said armature away from said engaged position thereof, and a piezoelectric device operatively associated with said shaft so that when said armature is in said engaged position and a force of said spring structure is insufficient to move said armature from contact with said contacted stator core, said piezoelectric device is constructed and arranged so that upon being energized, said piezoelectric device moves said shaft and thus moves said armature from contact with said contacted stator core.

9. The electromagnetic actuator according to claim 8, wherein said piezoelectric device comprises a plurality of piezoelectric elements defining a stack, said piezoelectric elements expand in length when energized.

10. The electromagnetic actuator according to claim 9, wherein said shaft extends through at least one of said electromagnets, and said piezoelectric device is coupled to a portion of said shaft which extends beyond an extent of said at least one electromagnet.

11. The electromagnetic actuator according to claim 10, wherein said at least one electromagnet is disposed in a housing, said shaft extending through said housing, one end of said stack being fixed to a surface of said housing, an opposite end of said stack being coupled to said portion of said shaft.

12. The electromagnetic actuator according to claim 11, further comprising a plate member coupling said opposite end of said stack to said portion of said shaft.

13. The electromagnetic actuator according to claim 9, wherein each of said piezoelectric elements are of disc-shape.

14. The electromagnetic actuator according to claim 13, wherein said piezoelectric elements are composed of ceramic.

15. The electromagnetic actuator according to claim 8, wherein said spring structure is a coil spring.

16. The electromagnetic actuator according to claim 8, including a voltage source to Provide said electrical signal to said electromagnets, and wherein said piezoelectric device is constructed and arranged so as to be powered by EMF voltage which is generated when the electrical signal to said contacted electromagnet is turned-off.

17. The electromagnetic actuator according to claim 3, wherein said piezoelectric elements are constructed and arranged to expand in a direction of an axis of said shaft to move said shaft and armature along said axis.

18. The electromagnetic actuator according to claim 10, wherein said piezoelectric elements are constructed and arranged to expand in a direction of an axis of said shaft to move said shaft and armature along said axis.

19. A method of moving an armature from contact with an electromagnet, the method including:

providing a piezoelectric device operatively associated with the armature; and energizing the piezoelectric device to move the armature from contact with the electromagnet.

20. A method of moving an armature from contact with an electromagnet, the method including:

providing a hold current to hold the armature in contact with the electromagnet, providing a piezoelectric device operatively associated with the armature, discontinuing the hold current to said electromagnet, and energizing the piezoelectric device to move said armature from contact with said electromagnet.

* * * * *